US005996675A

United States Patent [19]

Sturgis

[11] Patent Number: 5,996,675

[45] Date of Patent: Dec. 7, 1999

[54] DRAPERY TIEBACK SYSTEM

[76] Inventor: Cheryl S. Sturgis, 4804 NW. 14th Dr., Coconut Creek, Fla. 33063

[21] Appl. No.: 09/112,385

[22] Filed: Jul. 9, 1998

[51] Int. Cl.[6] ..... A47H 19/00

[52] U.S. Cl. ..... 160/349.2; 160/349.1

[58] Field of Search ..... 160/349.1, 349.2, 160/38, 330; 63/38

[56] References Cited

U.S. PATENT DOCUMENTS

| | | | |
|---|---|---|---|
| 1,381,817 | 6/1921 | Freeman | 160/349.1 |
| 1,829,880 | 11/1931 | Stockert . | |
| 2,226,502 | 12/1940 | Platt | 160/349.2 |
| 2,247,253 | 6/1941 | Rosenberg | 160/349.2 |
| 2,251,512 | 8/1941 | Bush et al. | 160/349.2 |
| 2,396,350 | 3/1946 | Tashman | 160/349.2 |
| 2,796,925 | 6/1957 | Woodward | 160/349.2 |
| 3,386,240 | 6/1968 | Blumstein . | |

FOREIGN PATENT DOCUMENTS

| | | | |
|---|---|---|---|
| 962192 | 4/1957 | Germany | 160/349.1 |
| 1902233 | 8/1970 | Germany | 160/349.2 |

*Primary Examiner*—Blair M. Johnson
*Attorney, Agent, or Firm*—Law Practice of Scott L. Lampert, PA; Scott L. Lampert

[57] ABSTRACT

A drapery tieback system comprising a drapery, a drapery tieback mounting assembly, a cord having a hook on each end and a plurality of beads slidingly strung therebetween on the cord. The cord and beads are structured to be wrapped around the drapery with the hooks attached to the tieback mounting assembly, thereby maintaining the drapery in folds to at least one side of an opening.

10 Claims, 2 Drawing Sheets

| Application Number | Contact Person | Applicant | Number of Sheets | Number of Figures |
|---|---|---|---|---|
| 09/112,395 | Scott Lampert 954 571-9920 | STURIS | 2 | 3 |

| Application Number | Contact Person | Applicant | Number of Sheets | Number of Figures |
|---|---|---|---|---|
| 09/112,395 | Scott Lampert 954 571-9920 | STURIS | 2 | 3 |

| Application Number | Contact Person | Applicant | Number of Sheets | Number of Figures |
|---|---|---|---|---|
| 09/112,395 | Scott Lampert 954 571-9920 | STURIS | 2 | 3 |

DRAPERY TIEBACK SYSTEM

BACKGROUND OF THE INVENTION

1. Field of the Invention

The present invention relates to draperies or curtains and, more particularly, a drapery tieback system.

2. Description of the Related Art

Tiebacks are commonly used with draperies to gather and retain the drapery towards the side(s) of an opening, most often a window. The benefits of such tiebacks are twofold, The first, and most obvious benefit, is that they retain the drapery away from the center of the window so that people inside the room can see outside and so that the outside light can pass into the room. The second benefit, and, for the reasons stated below, most likely the more important benefit to the drapery user, is that the resultant appearance when the drapery is retained by the tiebacks is aesthetically pleasing and often an important design feature of the room.

The prior art tieback devices focus on the apparatus or structure attached to the wall to which the drapery is tied. For instance, U.S. Pat. Nos. 4,022,415, 4,559,988, 4,903,370, 4,912,829, 5,078,199, D341,311 and D348,166 all disclose assemblies comprising some sort of bracket which is affixed to a wall adjacent the window and to which the drapery is tied.

However, when evaluating drapery accessories, such as ties, it is important to recognize that draperies or curtains are often chosen by those seeking to obtain a certain look or appearance when decorating a room. If they were merely seeking to cover a window, other more conventional, less expensive and maintenance free coverings would probably be selected. It is for this reason that draperies and other designer window coverings are now commonly referred to as window "treatments" and not merely window coverings. Thus, the overall appearance created by the draperies and their ancillary accessories are usually important to people who choose draperies as their window treatment.

With this in mind, applicant has discovered that conventional tiebacks have severe limitations which adversely effect the resultant appearance of draperies. Conventional ties are comprised of a fabric or cord having an appearance matching or enhancing the design of the drapery. Such fabrics and cords have inherent deficiencies which limit their functionality and aesthetic appearance. Specifically, the fabrics and cords must be adjusted to achieve the desired balance, that is, so that they rest at the same height and retain the drapery at the same position on both sides. This is a difficult balance to achieve and often requires significant trial and error similar to trying to balance a picture on a wall. Additionally, many fabrics and cords, because of their material, naturally create static, resistance and friction when in contact with the drapery, thereby causing them to become twisted or creasing the draperies and any pleats thereon. Furthermore, many fabrics and cords are not water resistant and, in fact, certain fabrics, such as silk, may be ruined if they become wet. Also, cleaning most fabrics and cords requires washing and drying or dry cleaning, which takes time, costs money, may result in the fabric or cord shrinking, stretching or otherwise becoming damaged and results in the loss of use of that fabric or cord for a period of time.

The prior art fails to recognize these problems and, consequently, there is no suggestion or motivation for one of ordinary skill in the art to modify any of the prior art devices in the manner disclosed by applicant's invention or in any other manner which might address these problems. Such lack of disclosure, suggestion or teaching in the prior art supports the conclusion that part of applicant's invention is the discovery of the problem, that is, the need for a drapery tie which addresses the many deficiencies of the prior art ties discussed above.

Accordingly there is a need in the art for a drapery tie which quickly and easily finds a natural equilibrium position, thereby requiring little adjustment, which creates less resistance and friction when in contact with the drapery, thereby preventing twisting and creasing, which includes means for preserving any pleats on the drapery and which is water resistant and easy to clean. The present invention is particularly suited to overcome those problems which remain in the art in a manner not previously known.

SUMMARY OF THE INVENTION

The present invention is directed towards a new and improved drapery tieback system comprising a drapery, a drapery tieback mounting assembly, a drapery tie having a cord with a hook on each end and a plurality of beads slidingly strung therebetween on the cord. The cord and beads are structured to be wrapped around the drapery with the hooks secured to the drapery tieback mounting assembly, thereby maintaining the drapery in folds to at least one side of an opening. Each bead on the first half of the cord is sized and shaped the same as the corresponding arranged bead on the opposite second half of the cord.

It is an object of the present invention to provide a new and improved drapery tieback system which has all the advantages of the prior art devices and none of the disadvantages.

It is another object of the present invention to provide a drapery tieback system having a tie which quickly and easily finds a natural equilibrium position, thereby requiring little adjustment.

It is also an object of the present invention to provide a drapery tieback system having a tie which is anti-static and creates less resistance and friction when in contact with the drapery, thereby preventing twisting and creasing of the tie and/or drapery.

It is yet another object of the present invention to provide a drapery tieback system having a tie which includes means for preserving any pleats on the drapery.

It is a further object of the present invention to provide a drapery tieback system having a tie which is water resistant and easy to clean.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

Figure 1:
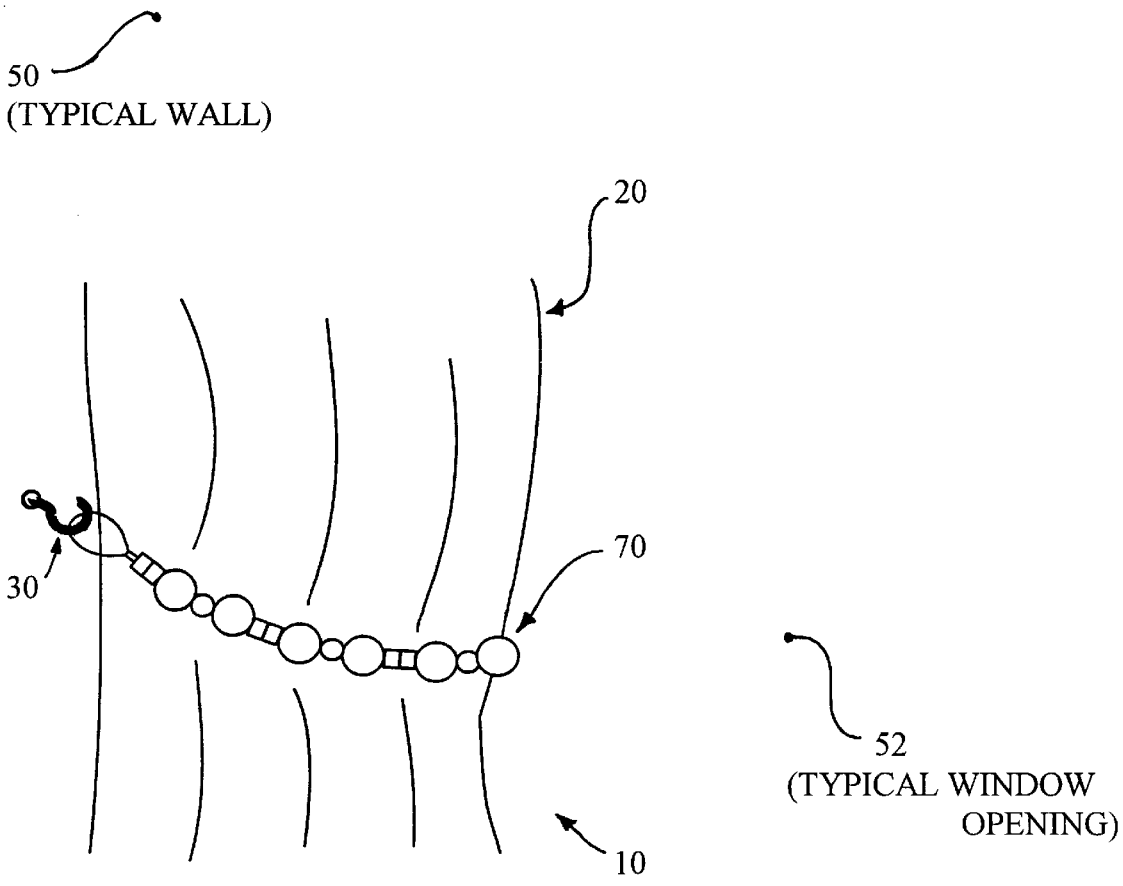
FIG. 1 is a front plan view of a drapery pulled to one side of an opening by the drapery tieback system of the present invention.
Figure 2:
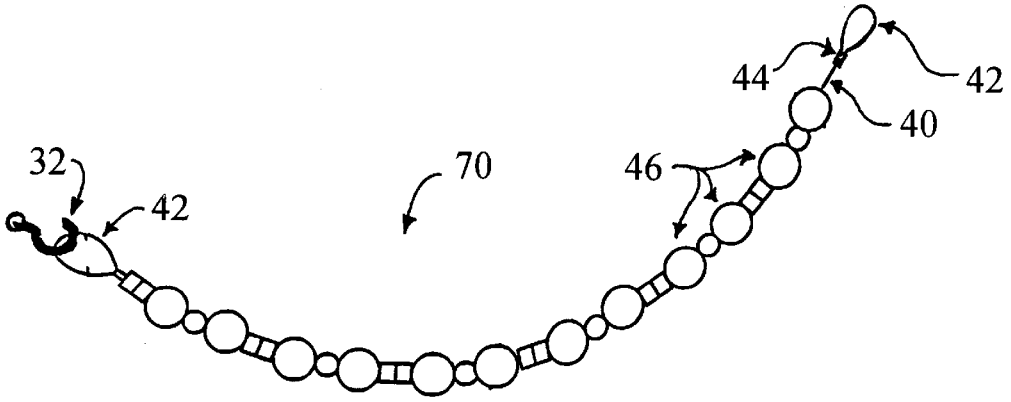
FIG. 2 is a front plan view of the beads on the cord with the hook secured to the drapery tieback mounting assembly.
Figure 3:
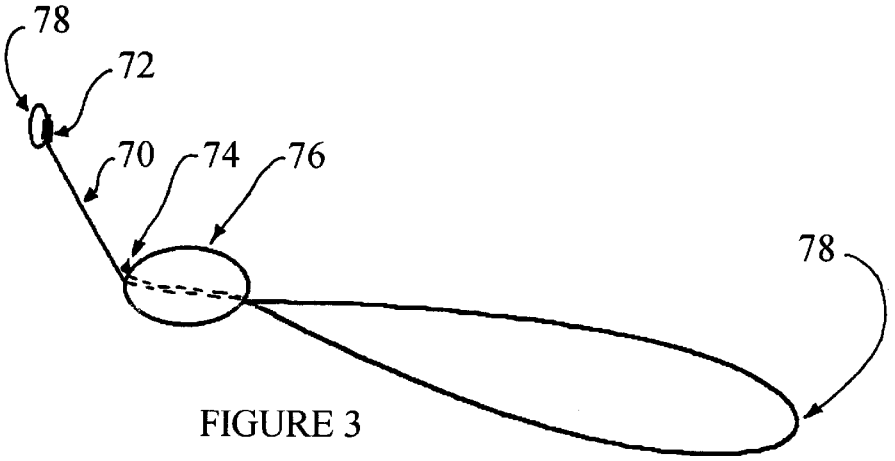
FIG. 3 is a front plan view of the extension means of the drapery tieback system of the present invention.

As shown in FIGS. 1–3, the present invention is directed towards a new and improved drapery tieback system 10 comprising a drapery 20, a drapery tieback mounting assembly 30 and a drapery tie 70. The drapery 20 may be any of those commercially available today structured to cover a window or other opening.

The drapery tie 70 includes a cord 40 having attachment means 42 on each end 44 and a plurality of beads 46 slidingly and rotatably strung on the cord 40 between the attachment means 42. The length of the cord 40 may vary, but must be long enough to wrap around the drapery 20 with the attachment means 42 on each end 44 secured to the tieback mounting assembly 30, so as to maintain the drapery 20 therebetween in folds to the side of the opening. The attachment means 42 is preferably enclosed loops integrally formed on the ends 44 of the cord 40, but may, alternatively, be any other type capable of being secured to the tieback mounting assembly 30.

The precise size and shape of the beads 46 may vary to achieve the desired aesthetic appearance. However, the beads 46 preferably include a generally rounded exterior surface to minimize any friction or resistance with the drapery 20, thereby reducing any twisting or creasing. Moreover, the generally rounded exterior surface of the various shaped beads 46 allow the drapery 20 pleats to fall into the grooves between the beads 46, thereby maintaining the integrity and uniformity of the pleats and creating a natural pattern for the drapery 20 fabric to follow.

The arrangement of the beads 46 on the cord 40 will effect the resultant equilibrium position of the cord 40 and beads 46 when the tie 70 is secured around the drapery 20. For instance, the tie 70 will quickly and easily find a natural equilibrium position when positioned around the drapery 20 if the size and shape of each bead 46 on the first half of the cord 40 is the same as the size and shape of each correspondingly arranged bead 46 on the second half of the cord 40. However, any arrangement may be used to achieve the desired aesthetic appearance.

The beads 46 may be selected from the many commercially available today, which are generally constructed of wood, plastic, metal, ceramic or any other suitable material. Such materials are generally water resistant, anti-static and easy to clean. The beads may be laminated or otherwise finished to achieve the desired aesthetic appearance.

The drapery tieback mounting assembly 30 may be one of the many commercially available today. Typically, the assembly 30 includes a pair of brackets 32 mounted to the wall 50 adjacent the opening 52 sought to be covered or decorated with each brackets 32 being structured and disposed to secure the ends of a drapery tie thereon. However, the number of brackets 32 used and their location on the wall 50 relative to the drapery is dependant upon the type of assembly 30 used and the appearance desired.

Referring to FIG. 3, the drapery tieback system 10 further includes means for extending the cord 40 when longer ties are necessary. The extension means includes a second cord 70 having a bead 76 slidingly mounted thereon, a first end 72, and an opposite second end 74. The first 72 and second 74 ends each include a loop 78, 78', one being structured for attachment to a loop 42 on the cord 40 and the other for attachment to the drapery tieback mounting assembly 30. The second cord 70, bead 76 and loops 78 are structured so that sliding the bead 76 towards the first end 72 acts to shorten the extension means and sliding the bead 76 away from the first end 72 acts to lengthen the extension means. This may be accomplished by inserting the second end 74 through the bead 76 in a first direction D1, looping the second end 74 back and inserting it through the bead 76 in an opposite second direction D2 and knotting 77, 77' the second end 74 of the cord 70 on both sides of the bead 76 so as to prevent the second end 74 from being pulled back through the bead 76 in the first direction D1 and the loop 78' from being pulled through the bead 76 in the second direction D2.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A drapery tieback system comprising:

a drapery;

a drapery tieback mounting assembly structured to support a drapery in folds to at least one side of an opening;

a first cord having a first half, an opposite second half and a plurality of beads rotatably strung thereon;

means for securing said first cord to said drapery tieback mounting assembly so that said drapery is maintained in folds to said at least one side of an opening by said plurality of beads; and extension means for extending said first cord, said extension means comprising a second cord having a bead slidingly mounted thereon, a first end with means for attachment to said first cord and an opposite second end, said extension means being formed by inserting said second end through said bead in a first direction, looping said second end back and inserting it through said bead in an opposite second direction and knotting said second end on both sides of said bead so that sliding said bead towards said first end acts to shorten said extension means and sliding said bead away from said first end acts to lengthen said extension means.

2. A drapery tieback system as recited in claim 1 wherein each of said plurality of beads on said first half are sized and shaped the same as said correspondingly arranged plurality of beads on said second half.

3. A drapery tieback system as recited in claim 1 wherein said drapery tieback mounting assembly comprises a plurality of brackets mounted adjacent said drapery, said plurality of brackets being structured and disposed to maintain said drapery in folds to at least one side of an opening by said plurality of beads.

4. A drapery tieback system as recited in claim 1 wherein said means for securing said first cord to said drapery tieback mounting assembly comprises a pair of loops, one of said loops being attached to a first end of said first cord and the other one of said loops being attached to a second opposite end of said first cord.

5. A drapery tieback system comprising:

a drapery;

a drapery tieback mounting assembly structured to support a drapery in folds to at least one side of an opening;

a first cord having a first half, an opposite second half and a plurality of beads rotatably strung thereon so that each of said plurality of beads on said first half are sized and shaped the same as said correspondingly arranged plurality of beads on said second half;

means for securing said first cord to said drapery tieback mounting assembly so that said drapery is maintained in folds to at least one side of an opening by said plurality of beads; and extension means for extending said first cord, said extension means comprising a second cord having a bead slidingly mounted thereon, a first end with means for attachment to said first cord and an opposite second end, said extension means being formed by inserting said second end through said bead in a first direction, looping said second end back and inserting it through said bead in an opposite second direction and knotting said second end on both sides of said bead so that sliding said bead towards said first end acts to shorten said extension means and sliding said bead away from said first end acts to lengthen said extension means.

6. A drapery tieback system as recited in claim 5 wherein said drapery tieback mounting assembly comprises a plurality of brackets mounted adjacent said drapery, said plurality of brackets being structured and disposed to maintain said drapery in folds to at least one side of an opening by said plurality of beads.

7. A drapery tieback system as recited in claim 5 wherein said means for securing said first cord to said drapery tieback mounting assembly comprises a pair of loops, one of said loops being attached to a first end of said first cord and the other one of said loops being attached to a second opposite end of said first cord.

8. A drapery tie for use with a drapery tieback system having a drapery and a drapery tieback mounting assembly structured to support a drapery in folds to at least one side of an opening comprising:

a first cord having a first half an opposite second half and a plurality of beads rotatably strung thereon;

a pair of loops structured to secure said first cord to a drapery tieback mounting assembly so that a drapery is maintained in folds to at least one side of an opening by said first cord and said plurality of beads, wherein one of said loops is attached to a first end of said first cord and the other one of said loops is attached to a second opposite end of said first cord; and extension means for extending said first cord, said extension means comprising a second cord having a bead slidingly mounted thereon, a first end with means for attachment to said first cord and an opposite second end, said extension means being formed by inserting said second end of said second cord through said bead in a first direction, looping said second end of said second cord back and inserting it through said bead in an opposite second direction and knotting said second end of said second cord on both sides of said bead so that sliding said bead towards said first end of said second cord acts to shorten said extension means and sliding said bead away from said first end of said second cord acts to lengthen said extension means.

9. A drapery tie for use with a drapery tieback system having a drapery and a drapery tieback mounting assembly structured to support a drapery in folds to at least one side of an opening as recited in claim 8 wherein each of said plurality of beads on said first half are sized and shaped the same as said correspondingly arranged plurality of beads on said second half.

10. A drapery tie for use with a drapery tieback system having a drapery and a drapery tieback mounting assembly structured to support a drapery in folds to at least one side of an opening as recited in claim 8 wherein said drapery tieback mounting assembly comprises a plurality of brackets mounted adjacent said drapery, said plurality of brackets being structured and disposed to maintain said drapery in folds to at least one side of an opening by said plurality of beads.

* * * * *